US006786256B2

(12) United States Patent
Sugawara

(10) Patent No.: US 6,786,256 B2
(45) Date of Patent: Sep. 7, 2004

(54) TABLE COVER PROVIDING FUNCTIONAL NAPKINS

(76) Inventor: Yukihiro Sugawara, Room 305, Komagome Heights 30, No. 21-8, Honkomagome 3-chome, Bunkyo-Ku, Tokyo (JP)

( * ) Notice: Subject to any disclaimer, the term of this patent is extended or adjusted under 35 U.S.C. 154(b) by 0 days.

(21) Appl. No.: 10/147,217

(22) Filed: May 14, 2002

(65) Prior Publication Data

US 2002/0172797 A1 Nov. 21, 2002

(30) Foreign Application Priority Data

May 15, 2001 (JP) ..... 2001-182577

(51) Int. Cl.[7] ..... B32G 3/06

(52) U.S. Cl. ..... 150/158; 428/99; 428/100; 428/136; 428/192; 108/90

(58) Field of Search ..... 428/99, 100, 192, 428/136; 24/7, 9; 150/158; 108/90; 2/49.1, 49.3

(56) References Cited

FOREIGN PATENT DOCUMENTS

| | | |
|---|---|---|
| JP | 3019803 | 10/1995 |
| JP | 3067791 | 1/2000 |

*Primary Examiner*—Alexander S. Thomas
(74) *Attorney, Agent, or Firm*—Jay L. Chaskin

(57) ABSTRACT

A table cover comprises a rectangular sheet material such as a cloth, a synthetic resin material etc., and multiple napkin pieces which is of the same material and is formed in a body with the cover, respectively. The napkin pieces project beyond side edges of the sheet material and are cut off at both side portions by a fixed length from the sheet material. The napkin pieces also are attached by optional sets of fastening members or buttons at projected edges and on their opposite portions inward of the side edges of the sheet material. The napkins can be maintained cleanly on the table surface by scraping up spilled foods or spilled liquids thereon into the napkin portions on one's lap and prevent soiling clothing or carpet, during a meal. The napkin pieces can also be held back to fix them within the sheet side portions, when not in use. The table cover then can be used in the usual manner on a dining table.

24 Claims, 6 Drawing Sheets

TABLE COVER PROVIDING FUNCTIONAL NAPKINS

CROSS-REFERENCE TO RELATED APPLICATIONS

This application claims priority under 35 U.S.C. §119 to Japanese Patent Application No. 2001-182577 filed May 15, 2001, he entire contents of which is hereby incorporated by reference.

BACKGROUND OF THE INVENTION

This invention relates to a table cover providing functional napkins and more particularly to functional napkins that can prevent contamination of a dress and can collect dropped off a table, during a meal.

Customarily, it has been in fashion to use a table cover including a table cloth selected by one's choice or one's sense, for prevention of dirt on a table surface and for representation of a pleasant spot during the meal.

While, these table covers have been provided in various types so that the market enables to supply not only various materials to correspond with any one's likings, for example, a cloth, a synthetic resin sheet, a water proof table cover adhered to a cloth and a transparent sheet to give a cloth taste, but also various designs, patterns, or appearances thereof.

These table covers have generally been used for prevention of dirt on a surface of the table and for enhancement of an atmosphere in a dining room.

In another way, an infant or an old man sometimes spills on the table food or contaminates his clothing or a carpet as the former cannot take well the meal, and the latter is inconvenient of his body. Accordingly, the former wears a bib and the latter puts a napkin or a towel on his lap for meal, respectively, for the above purposes, under certain circumstances, the latter uses an apron having a private pocket for spilled foods.

In view of such spilled foods, during the meal, Japanese Utility Model Registration Nos. 3019803 and 3067791 teach, respectively, a table cover which prevents dirt on the dress even if the food is spilled during the meal.

Utility Model Registration No. 3019803 teaches a table cover providing four pieces of cloth attached on its four sides by tape fasteners to form four bend portions so that crumbs or spilled liquids, during the meal, can be received in those portions and maintained cleanly on the table surface.

Utility Model Registration No. 3067791 discloses a table cover that can be used both as a bib and a table cloth by attaching a string on one side of a rectangular vinyl cloth the sane size as the table surface. In use, the table cover is spread on the table to put on the tableware, after the string is tied about a neck of the infant or the old man, and thereafter they can take the meal, without any dirt on their dresses or on the carpet The table surface can be also maintained cleanly to use again, without any sweeping, by merely washing the removed table cover. The prior art clearly teach respectively table covers directed to an infant or to an old deformed person, which can prevent dirt on the table surface and the dress, during the meal.

As mentioned above, various products and arts, such as the convenient napkin and bib which can receive spilled food during the meal as well as the table covers, have been provided for the dining market for the production of a pleasant meal, prevention of dirt and reduction of a charge for an attendant of the infant or the old deformed person, and those products to be indispensable fixtures for the dining table, in the future. Particularly a household that uses napkins as a table manner, is recently increasing even if there is no infant or deformed old person.

Meanwhile, all persons including an adult, the infant and the deformed old person have to take respectively a meal everyday and, in each meal of the infant and the deformed old person, the mother or family had to surely help with their meal so that they can take it without spilling out the tableware and without contaminating clothing, carpet or floor by the spilled foods. This indispensable assistance every day is heavy work for the related persons, not to say nothing of themselves.

The table covers described hereinabove for the prevention of dirt on the dress and the table surface during the meal of such an infant and deformed old person, could attain some effects in its own way for their purposes, however, they have still the following inconveniences and faults.

An exclusive apron or bib providing a large pocket is objectionable to the infant or the deformed old person but could attain a certain effect for the prevention of dirt on the dress or carpet however, the spilled food thereon could not be received into the pocket because the infant does not take the meal quietly, and the pocket is smashed because it is attached at the front portion and moreover the meal is taken at a position such as to overlap the table. Accordingly, such an apron or bib for the meal is not effective for them. Contrary, the deformed old person takes the meal calmly, however, most of them dislike using such a private apron or bib because it is unattractive and gives him a sense of incongruity with the family during use.

Additionally, the table cover disclosed in Utility Model Registration No. 3019803 comprises a table cloth covered on a table surface and the table cloth pieces formed respectively on four sides of the former hem for also receiving crumbs and spilled liquids. However, they can merely receive the spilled crumbs and liquids on the table surface and those crumbs and liquids have to be scraped down into the hems after the latter is closed by tape fasteners which are released every time. Accordingly, the table cloth is inconvenient to use and has other shortages because the prevention of the dirt on a dress or carpet is impossible due to the hem portions being attached shortly around the dining table. Disposal of the table cloth is also very much troublesome.

The table cloth of Utility Model Registration No. 3067791 discloses a rectangular table cloth which is used both as a bib and table cloth and has attached a string on one side of a vinyl cloth covered on a table surface. The cover is not a novel table cover because it is merely a large size bib and further does not have a constant space or surplus between the vinyl cloth for the prevention of dirt and a portion of the infant's neck, when it is used during the meal, as it is directly tied around the neck. Therefore, the table cover can neither affect technically nor actually the anticipation of a user for the tablewares thereon to be removed and over-turned, according to a replacement of the table cover linked with a movement of the infant.

BRIEF DESCRIPTION OF THE INVENTION

In order to over-come the above faults and inconveniences, an embodiment of the present invention provides a table cover having functional napkins which can enhance an atmosphere during the meal, be maintained clean on a table surface, prevent dirt on the dress, and receive spilled food on the table into turned-over portions of the napkins.

The table cover comprises a rectangular sheet of a larger cloth or synthetic resin material than the table surface, and provides napkin pieces attached on longitudinal both sides of the rectangular sheet and projected in a fixed length and width from the table cover edges.

The napkin pieces are cut off at sides respectively until near portions of the table surface edges and plural sets of fastening means such a male-female planar fasteners or hooks are furnished on the edges of the cut napkins and on near portions of the table edges opposed to the edges of the cut napkins when they are held back. The napkins therefore may be held back around all the side portions of the rectangular sheet on the table surface when the meal is taken, and contrarily, during the meal, they can freely be used after release from the latter portions.

The functional napkins also provide a string or a hanging loop respectively on their edge portions to maintain them exactly on one's lap to prevent dirt on the dress or carpet, etc., as described hereinafter in detail.

Accordingly, an embodiment of the present invention to provide a table cover having functional napkins projected through edges of the former and cut on both sides to an appointed depth on the former to prevent dirt on the dress or carpet and to be clean on the table surface by scraping off spilled foods or liquids thereon into the functional napkins turned up on one's lap and further providing plural sets of male-female fastening members at their edge portions and opposite for holding back on all sides of the former, respectively.

An embodiment of the present invention is to provide for a table cover having the above functional napkins and the latter providing plural sets of male-female planar fasteners or hooks at corresponding portions for the fastening members, for the same sake as the above.

An embodiment of the present invention is to provide for a table cover having the above functional napkins attached on their edges respectively a string of an appointed length to cover exactly one's front portion by hanging it around one's neck for the same sake as the above.

An embodiment of the present invention is to provide for a table cover having the above functional napkins which are made separately and attached detachably on the former by plural set of male-female fastening members on an end of the back surface of the latter and on opposite portions on the surface of the former, for holding back of the latter, at all sides of the former.

An embodiment of the present invention is to provide for a table cover having the above fictional napkins which are separately and attached detachably on the former by plural sets of male-female members set on an end of the back surface of the latter and on more inward portions than opposite portions on the surface of the former, for holding back of the latter at all sides of the former.

An embodiment of the present invention is to provide a table cover having above functional napkins providing slip-proof members on their back to fix them on each one's lap, during a meal.

BRIEF DESCRIPTION OF THE DRAWINGS

The present Invention will become more apparent from the following description and the attached drawings, wherein.

DETAILED DESCRIPTION OF THE INVENTION

Figure 1:
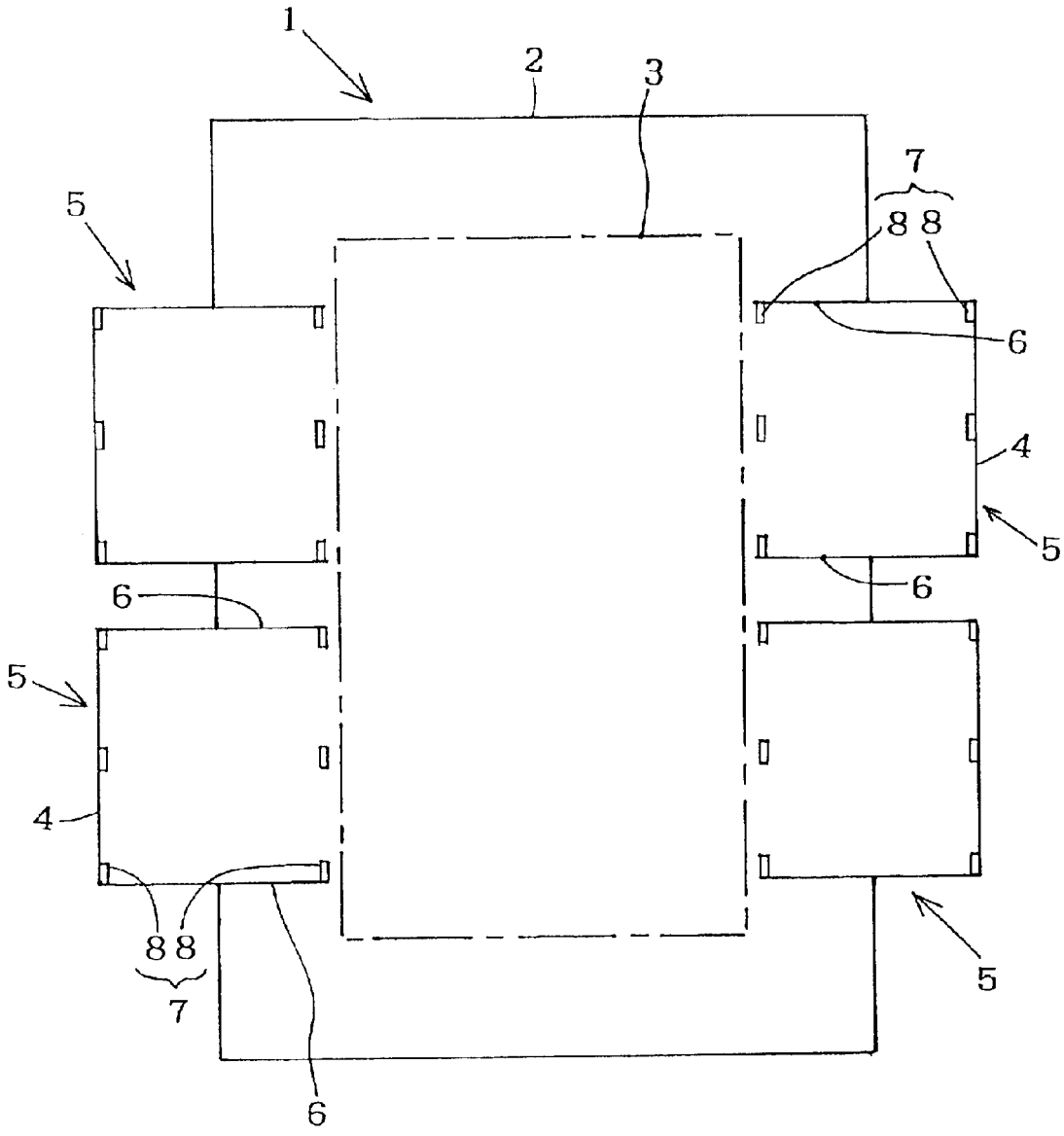
FIG. 1 is a development view of a table cover for an embodiment of the present invention.
Figure 2:
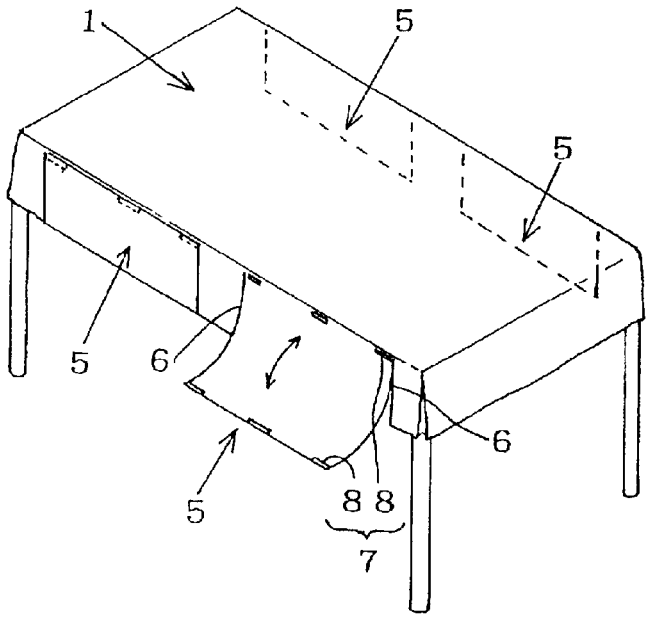
FIG. 2 is a perspective view of the table cover of FIG. 1 covered on a table.
Figure 3:
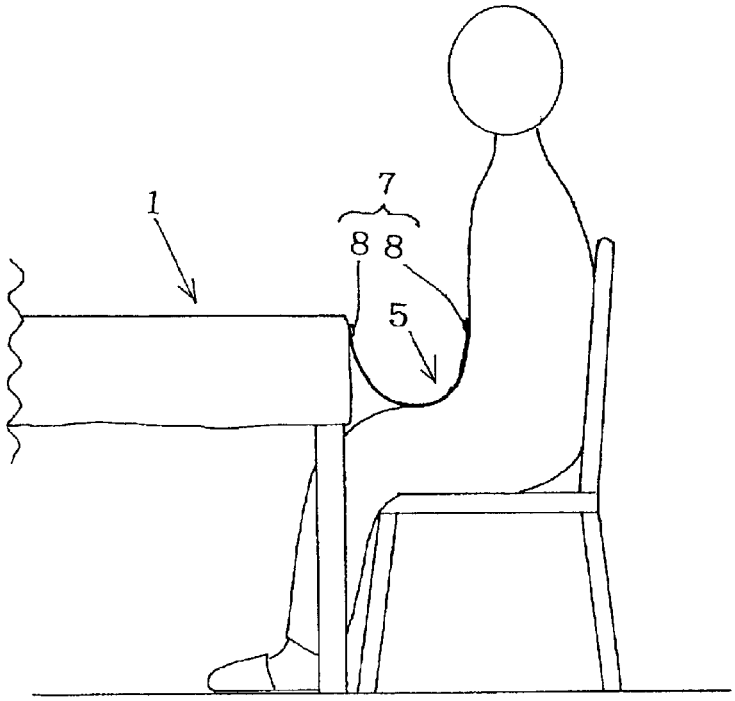
FIG. 3 is a side view showing usage of the table cover of FIG. 1, during a meal.

An embodiment (Example 1) of the present invention shown in FIGS. 1 to 3, is a table cover 1 which comprises a rectangular sheet 2 of a cloth or a synthetic resin material as a base and two napkin pieces 5 shown as projected pieces 4, which are in a body with the sheet at both its longitudinal side portions, and have a length, from their edges to near portions of the table edge place inwardly on the sheet 2, and a width which can cover sufficiently over one's lap respectively.

The functional napkins 5 separate laterally from each other in a fixed distance are also cut off at both sides with two slits 6, until the edges of the sheet 2 from the near portions of the table edges covered by the longitudinal side portions of the sheet 2, and plural sets of fastening members 7 such as male-female planar fasteners are prepared at the edge portions of the napkins 5 and the near portions of the edges of the table 3 to fix them by holding back on both longitudinal side portions of the table sheet 1, when the napkins are not in use.

Accordingly, the table cover 1 may be used as a table cloth to cover the table together with napkins which prevent dirt of a dress or carpet by covering merely the lap of the user and also seen apparently as a common table cover, when not in use because the napkins can be easily fixed within its side portions by holding back them, with several sets of the planar fasteners 8 thereon, after cleaning only their dirt portions, as shown in FIG. 2.

Figure 4:
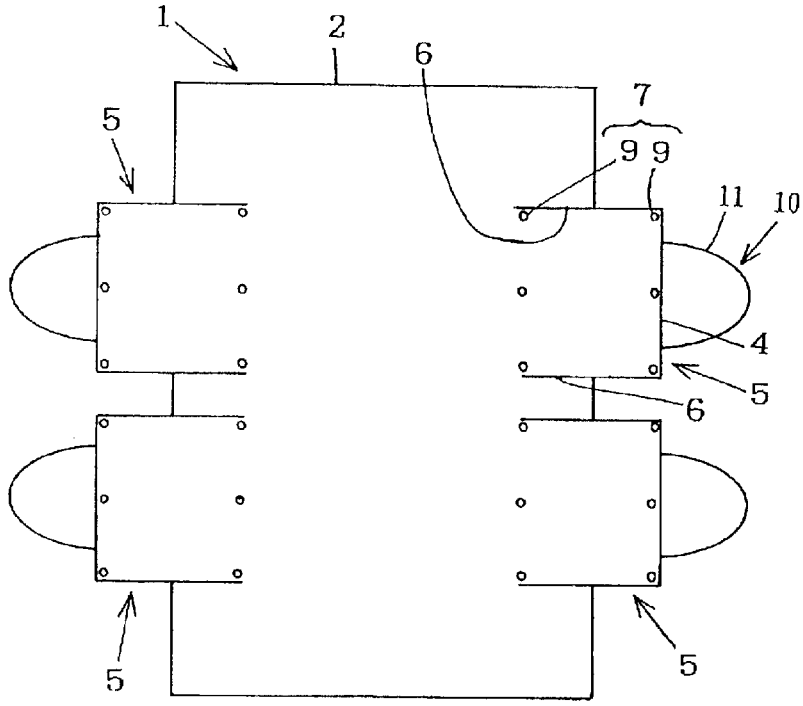
FIG. 4 is a development view of a table cover for another embodiment of the present invention.
Figure 5:
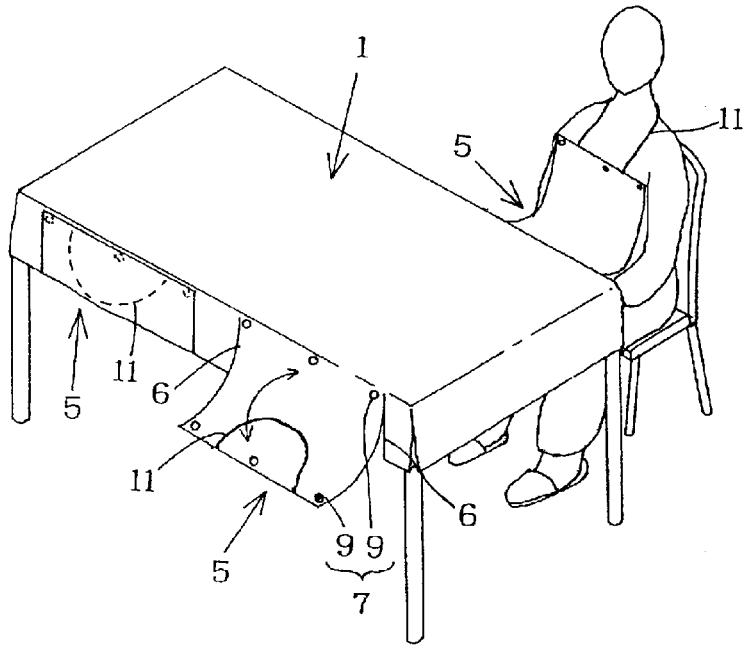
FIG. 5 is a perspective view of the table cover of FIG. 1, covered on a table, during a meal.

An embodiment of the present invention (Example 2) is shown in FIGS. 4 and 5. A table cover comprises almost the same form and sane components as the embodiment of Example 1, except for hanging ropes 11, attached on each edge of the napkins 5 having a length which enable them to hang sufficiently around one's neck and for several sets of hooks 7, equipped on the same portions for the planar fasteners 7 shown in FIGS. 1 and 2.

The napkin 5 are respectively fixed on each side portion of the table cover 1 by the sets of hooks 7 after being held back by the hanging ropes 11, as shown in FIG. 5. In use the napkins are released from the side portion of the table cover firstly by discharging a connection of the hooks 7 and the hanging rope 11 that is held around the neck, after pulling it out from inside of the held back napkin 5. The napkin piece 5 is held around the neck by the rope 11 with enough room that a little more or more movement of an infant, during the meal, is absorbed therebetween without any delivery of the movement to the napkin piece 3 or the table cover 1, due to free movement of the napkin and the hanging rope 11 around the neck. Accordingly, there is no slightest fear of oven of an article on the table by such movement of the infant, during the meal.

Figure 6:
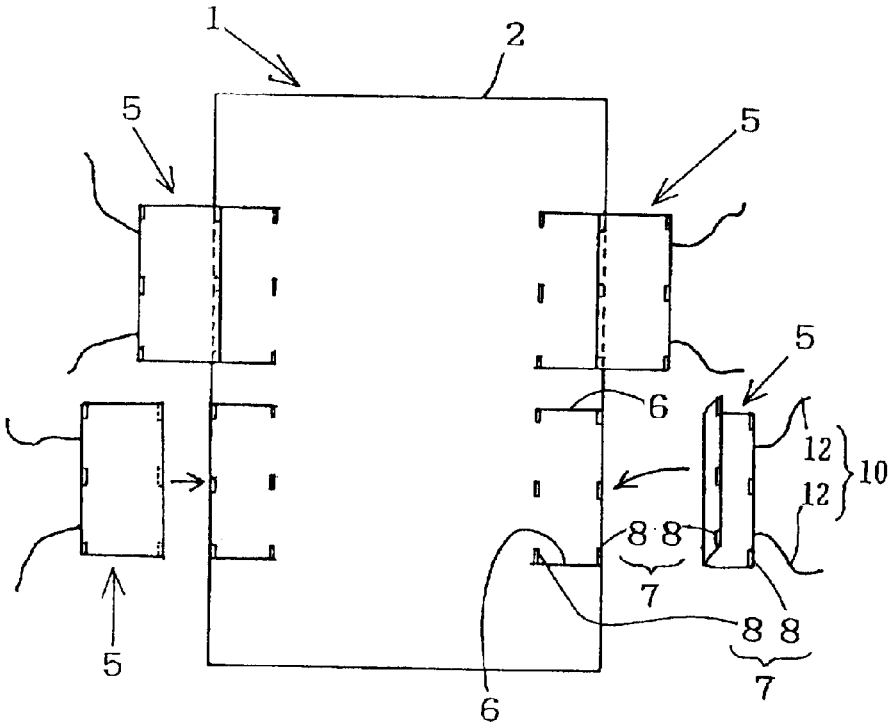
FIG. 6 is a development view of a table cover for another embodiment of the present invention.

A table cover shown in FIG. 6, is another embodiment (Example 3), and comprises a rectangular sheet 2 detachable napkin pieces 5 in the sheet. Two longitudinal side portions of the sheet 2 form a main body of the table cover 1, and provide two sets of slits 6 having the same length and same width as those described in each embodiment above, half set of fastening member 7, such as male-female planar fasteners 8, are attached on one edge of the sheet material between the slits 6, for means for connecting of the napkin pieces made of the same material and separately made from the sheet 2, respectively, While, other half set of the planar fasteners 8 also attached on one edge of a back surface of the napkins 5 which was made separately in the width as a distance between the two slits 6 and a half length of the slits respectively.

Furthermore, another fastener means 7 for holding back the napkins 5, such as some sets of male-female planar fasteners 8 are prepared at opposite portions for holding the turned napkins 5 on both longitudinal sides of the table cover, and string members 10, such as sets of stings having a desirable length to tie them around the neck, are also attached on opposite sides of the planar fasteners 8 prepared on the back surfaces of the napkins. Thus, the napkins 5 provide for another functional table cover 1 with the rectangular table sheet described hereinbefore.

Accordingly, the embodiment in Example 3 provides not only the same function and the handling but also the effect as the embodiments in Examples 1 and 2, and provide a further effect such that a suitable length of the strings to be tied around the neck, when eating can be easily adjusted for a short torso child, etc., due to a tying system formed by the two strings. Further, the soiled napkin pieces 5 can be washed separately after being removed from the table cover 1.

Figure 7:
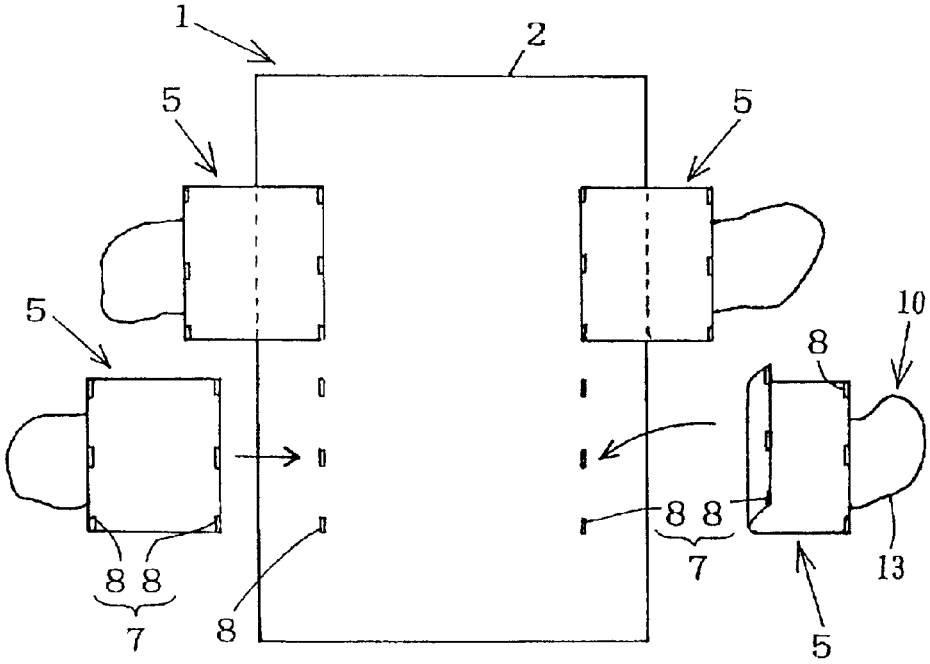
FIG. 7 is a development view of a table cover for still another embodiment of the present invention.

A table cover 1 of a further embodiment (Example 4) is of the same type as Example 3 in that the functional napkins pieces 5 are respectively detachable from both sides of the table cover 1, except for having no slits for the napkins on both sides of the table cover and being of double length and the width as the napkins in Example 3. The rectangular table sheet 2 constitutes a main body of the table cover 1, and provides half sets of planar fastener pieces 8 at near portions of the edges for the table surface hereunder and at one of the edges for its longitudinal side portions, respectively. The napkin pieces are also prepared separately from the sheet 2 and half sets of the planar fasteners opposite to above other half sets of planar fasteners are attached on the back edges of the napkin pieces 5 so that the napkin pieces can be attached detachably on the side portions of the table cover 1. The fasteners are further attached on both edges of their surfaces respectively some sets of male-female planar fastener 8 to hold them back on both sides of he sheet, when not in use. While, the napkins provide also an elastic hanger 10, such as a rubber band 13, at one edge of the napkins respectively, as shown in FIG. 7.

Figure 8:
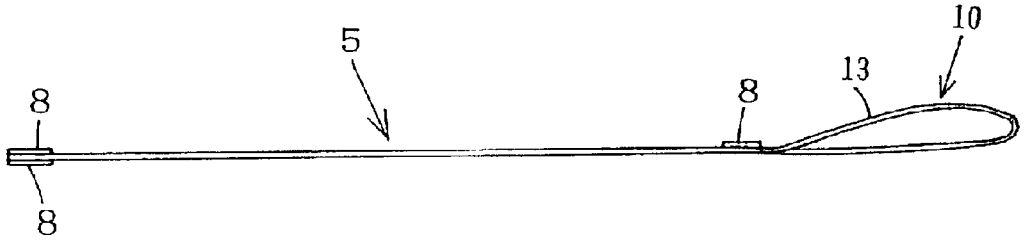
FIG. 8 is a side view of a functional napkin according to an embodiment of the present invention providing a string on its edge for hanging around one's neck.
Figure 9:
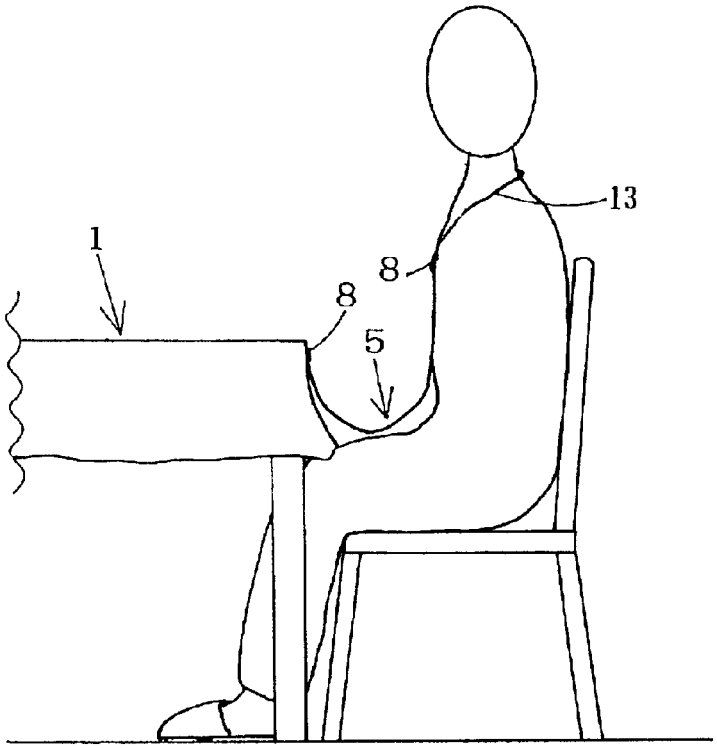
FIG. 9 is a side view showing a table cover providing the functional napkins in FIG. 8, during a meal.

The embodiment in Example 4 is of the same type fundamentally as Example 3, except for the former lacking two sets of slits for the napkins 5 and some sets of fastener members such as the plant fasteners 8 at edges of both sides of the table cover 1, and the napkins have a double length of the embodiment in Example 3, respectively. Accordingly, the table cover 1 in Example 4 is simpler than in Example 3 and the napkins 5 made separately from the table cover 1 have the same effect as the embodiment of Example 3, even if they have no slits on both sides of the table cover 1, as they not only have a double length as in Example 3 and an elastic hanger 13 at edges but also some sets of planar fasteners 8 opposite to the planar fasteners attached at near portions of the edge portions of the table surface on both sides of the table cover 1, as shown in FIG. 8. Consequently, the table cover 1 can minimize influences of the various movements transferred through the napkins 5 because the elastic hanger 13 attached on the latter can freely extend to correspond to differences of the sitting height and to sufficiently absorb the movement thereon, due to the longer napkins and elongation of the hanger, as shown in FIG. 9.

Figure 10:
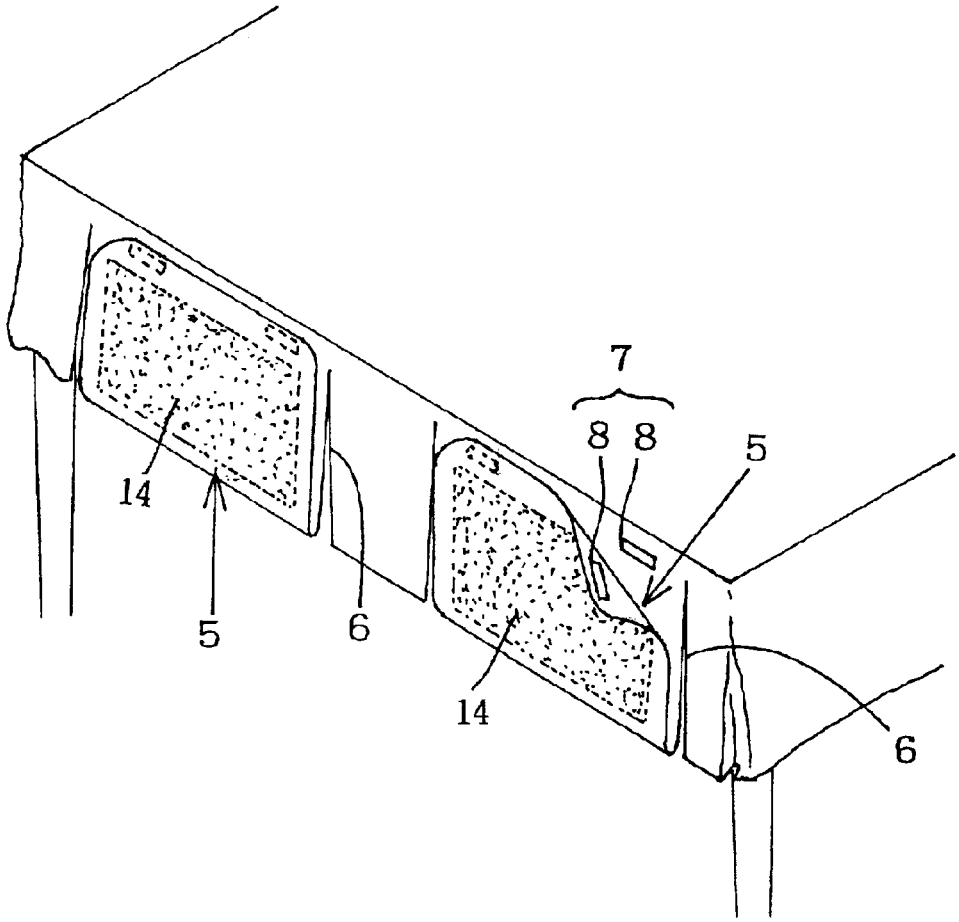
FIG. 10 is a perspective view showing functional napkins of the present invention providing a slide-proof member respectively on their back and held back on a side portion of a table cover on a table.

Another embodiment (Example 5) of the table cover 1 is shown in FIG. 10 almost the same type as shown in the examples described hereinbefore, except for functional napkins 5 providing slide-proof members 14 on their back surfaces. The napkins 5 are prevented from slipping down or moving about themselves when in use on the laps, due to increased resistance between the lap and the napkin. The napkins 5 are able to be held back on all side portions of the table cover 1 as in the other embodiments as shown in FIG. 10.

In the embodiments, each set of the fastening members 7 on the napkins 5 and the table sheet 2 may be a button or set of hooks and/or the like, and the multiple short planar fastener series shown in each drawing may be replaced by a long planar fastener. The napkins 5 may be prepared not only on both longitudinal sides but also on all sides of the table cover 1. The colors or patterns of the napkins are of course of free choice, according to one's own taste for a pleasant place during the meal.

Various modifications or substitutions of equivalent components, colors, patterns, forms, and/or functions may be made by those skilled in the art to the disclosed embodiments without departing from the scope and extant of the invention.

What is claimed is:

1. A table cover comprising:

(a) a sheet;

(b) at least one napkin piece formed on the sheet;

(c) the at least one napkin piece having a given width and length;

(d) the sheet and the at least one napkin being formed as one sheet;

(e) one or more of the least napkin being formed on one or more sides of the sheet;

(f) means for fastening disposed on an edge portion of the sheet; corresponding means for fastening disposed on opposite portions of the at least one napkin piece; and (h) both sides of the at least one napkin piece is cut off by a given length from edges of the sheet.

2. The table cover according to claim 1 wherein the mean for fastening and the corresponding means for fastening comprise sets of male-female planar members.

3. The table cover according to claim 2 wherein means for hanging are attached to edges of the at least one napkin piece.

4. The table cover according to claim 3 wherein the at least one napkin piece have means for avoiding sliding on their back surface.

5. The table cover according to claim 3 wherein the means for hanging is adjustable.

6. The table cover according to claim 5 wherein the means for hanging is adjustable.

7. The table cover according to claim 2 comprising:

(a) the at least one napkin piece is made respectively from the sheet;

(b) the at least one napkin piece providing one or more means for fastening on opposite edges of their surfaces;

(c) one or more parts of the means for fastening being attached on back edges of the napkin pieces and on near inward portions of the sheet opposed to the a least one napkin piece;

(d) so that the pieces are detachable from the sheet.

8. The table cover according to claim 2 wherein the at least one napkin piece have means for avoiding sliding on their back surface.

9. The table cover according to claim 1 wherein means for hanging are attached to edges of the at least one napkin piece.

10. The table cover according to claim 9 comprising:

(a) the at least one napkin piece is made respectively from the sheet;

(b) the at least one napkin pieces providing one or more means for fastening on opposite edges of their surfaces;

(c), one or more parts of the means for fastening being attached on back edges of the at least one napkin pieces and on near inward portions of the sheet opposed to the at least one napkin pieces;

(d) so that the pieces are detachable from the sheet.

11. The table cover according to claim 9 wherein the napkin pieces having means for avoiding sliding on their back surface.

12. The table cover according to claim 9 wherein the means for hanging is adjustable.

13. The table cover according to claim 12 wherein the means for hanging is adjustable.

14. The table cover according to claim 1 comprising:

(a) the at least one napkin piece is made respectively from the sheet;

(b) the at least one napkin piece providing one or more means for fastening on opposite edges of their surfaces;

(c) one or more parts of the means for fastening being attached on back edges of the at least one napkin piece and on near inward portions of the sheet opposed to the at least one napkin piece;

(d) so that the at least one piece is detachable from the sheet.

15. The table cover according to claim 14 wherein the at least one napkin piece have means for avoiding sliding on their back surface.

16. The table cover according to claim 14 wherein means for hanging are attached to edges of the at least one napkin piece.

17. The table cover according to claim 16 wherein the means for hanging is adjustable.

18. The table cover according to claim 1 wherein the at least one napkin piece have means for avoiding sliding on their back surface.

19. The table cover according to claim 1 wherein the means for fastening is disposed on only the surface of the side portion of the sheet and not on the surface and the back of the side portions; and the means for fastening is disposed on only the surface of the at least one napkin piece and on the back of the at lest one napkin piece.

20. The table cover according to claim 1 wherein the means for fastening comprises two rows of two fasteners on the sheet and one row of two fastener on the at least one napkin piece.

21. A table cover comprising:

(a) a sheet;

(b) at least one napkin piece made separately from the sheet;

(c) the at least one napkin piece having one or more means for fastening on opposite edges of their surfaces; and (d) one or more parts of the means for fastening being attached on back edges of the napkin pieces and edges of the sheet, respectively (e) so that the napkin pieces are detachable from the sheet.

22. The table cover according to claim 21 wherein the at least one napkin piece have means for avoiding sliding on their back surface.

23. The table cover according to claim 21 wherein means for hanging are attached to edges of the at least one napkin piece.

24. The table cover according to claim 21 wherein the means for hanging is adjustable.

* * * * *